US006889636B2

(12) United States Patent
Yang

(10) Patent No.: US 6,889,636 B2
(45) Date of Patent: May 10, 2005

(54) TWO-CYCLE ENGINE

(76) Inventor: David S. W. Yang, 10003 Autumnview La., Ellicott City, MD (US) 21042

( * ) Notice: Subject to any disclaimer, the term of this patent is extended or adjusted under 35 U.S.C. 154(b) by 0 days.

(21) Appl. No.: 10/653,118

(22) Filed: Sep. 3, 2003

(65) Prior Publication Data

US 2005/0045122 A1 Mar. 3, 2005

(51) Int. Cl.[7] ..... F01L 3/06
(52) U.S. Cl. ..... 123/65 VB
(58) Field of Search ..... 123/65 VD, 65 VB, 123/65 VC, 65 P, 90.11, 73 C; 251/129.01

(56) References Cited

U.S. PATENT DOCUMENTS

| | | | | |
|---|---|---|---|---|
| 3,882,833 | A | | 5/1975 | Longstaff et al. |
| 4,075,986 | A | | 2/1978 | Keck |
| 4,271,800 | A | | 6/1981 | Borracci |
| 4,375,793 | A | | 3/1983 | Seilly et al. |
| 4,445,467 | A | | 5/1984 | Westerman et al. |
| 4,762,095 | A | | 8/1988 | Mezger et al. |
| 4,794,890 | A | | 1/1989 | Richeson, Jr. |
| 4,995,347 | A | | 2/1991 | Tate et al. |
| 4,995,350 | A | | 2/1991 | Kumagai et al. |
| 4,995,354 | A | | 2/1991 | Morikawa |
| 5,095,856 | A | | 3/1992 | Kawamura |
| 5,107,801 | A | | 4/1992 | Huang |
| 5,111,779 | A | | 5/1992 | Kawamura |
| 5,117,213 | A | | 5/1992 | Kreuter et al. |
| 5,131,354 | A | | 7/1992 | Richeson |
| 5,133,309 | A | | 7/1992 | Ishii |
| 5,154,141 | A | | 10/1992 | McWhorter |
| 5,158,046 | A | | 10/1992 | Rucker |
| 5,159,903 | A | | 11/1992 | Takahashi |
| 5,163,388 | A | | 11/1992 | Jonsson |
| 5,180,006 | A | | 1/1993 | Marsais et al. |
| 5,189,996 | A | | 3/1993 | Richeson et al. |
| 5,191,858 | A | | 3/1993 | McWhorter |
| 5,331,929 | A | | 7/1994 | Plantan |
| 5,515,818 | A | | 5/1996 | Born |
| 5,615,644 | A | | 4/1997 | Nuti |
| 5,746,163 | A | | 5/1998 | Green |
| 5,772,179 | A | | 6/1998 | Morinigo et al. |
| 5,775,274 | A | | 7/1998 | Duret et al. |
| 5,809,949 | A | | 9/1998 | Duret |
| 5,857,435 | A | | 1/1999 | Yang |
| 5,887,553 | A | | 3/1999 | Ballmann et al. |
| 6,006,714 | A | | 12/1999 | Griffin et al. |
| 6,044,812 | A | | 4/2000 | Bivens |
| 6,044,813 | A | | 4/2000 | Bulgatz et al. |
| 6,085,704 | A | | 7/2000 | Hara |
| 6,095,111 | A | * | 8/2000 | Ueda et al. ..... 123/254 |
| 6,101,989 | A | | 8/2000 | Green |
| 6,135,070 | A | | 10/2000 | Crandall |
| 6,202,607 | B1 | | 3/2001 | Kreuter |
| 6,216,653 | B1 | | 4/2001 | Hara et al. |
| 6,354,253 | B1 | | 3/2002 | Katsumata et al. |
| 6,360,719 | B1 | | 3/2002 | Uitenbroek |
| 6,390,036 | B1 | | 5/2002 | Yuuki |

(Continued)

*Primary Examiner*—Henry C. Yuen
*Assistant Examiner*—Hyder Ali
(74) *Attorney, Agent, or Firm*—Rosenberg, Klein & Lee

(57) ABSTRACT

A two-stroke cycle internal combustion engine (10) has a one-piece cylinder housing (14) which is vertically aligned with a crank housing (16) and a valve housing (12) mounted at a top section of the cylinder housing. The valve housing (12), cylinder housing (14), and crank housing (16) are generally formed in a substantially symmetrical manner about a vertical axis line (20). The valve housing (14) contains a valve control mechanism (54) which aids in the reversible vertical placement of a valve member (34) having an extended length value stem (38) and a valve head (36). A controlled air insertion mechanism (92) provides for high pressure air to be inserted into a combustion chamber (42) to thoroughly expel spent gases through exhaust port 46 and there is further provided a recess (102) for cooperation with a relief opening (104) to relieve gas pressures built up.

18 Claims, 6 Drawing Sheets

U.S. PATENT DOCUMENTS 6,446,588 B2 9/2002 Yamada et al.
6,474,275 B1 11/2002 Drecq
6,516,758 B1 2/2003 Leiber
6,532,919 B2 3/2003 Curtis et al.
2001/0029918 A1 10/2001 Qattan
2002/0152983 A1 10/2002 Muth

* cited by examiner

TWO-CYCLE ENGINE

BACKGROUND OF THE INVENTION

1. Field of the Invention

This invention relates to internal combustion engines. In particular, this invention relates to two-stroke cycle engines. More in particular, this invention directs itself to a two-stroke cycle engine which includes a unitarily formed cylinder housing which is formed in either one-piece formation or is coupled to a valve housing.

Additionally, this invention relates to an overall two-cycle engine where the main components include a valve housing, cylinder housing, and crank housing combination aligned in a vertical direction and where the combination is generally symmetrical about a vertical axis.

This invention is particularly directed to a two-stroke cycle engine where a valve housing includes a trigger mechanism which interfaces with a stop member formed on a valve member where the valve member includes a valve head and an elongated stem portion. Still further, this invention pertains to a two-stroke cycle engine where a valve trigger mechanism interfaces and blocks the displacement of the valve member at predetermined times within the stroke cycle. Still further, this invention pertains to a valve housing containing a valve trigger mechanism where the trigger mechanism is inserted into and out of the path of the vertically displaceable valve member to both terminate valve member displacement and initiate valve member displacement in an upward direction.

Further, this invention pertains to a two-stroke cycle engine having a valve housing which includes a valve trigger mechanism which is under the control of a solenoid trigger.

More in particular, this invention relates to a two-cycle engine where a high pressure controllable air insertion mechanism is coupled to a lower portion of the valve housing for insert of high pressure air into an air inlet plenum prior to insertion into the combustion chamber of the two-cycle engine.

Further, this invention relates to a controllable air insertion mechanism which is mounted to a lower section of a valve housing where the controlled air insertion mechanism includes an outer wall which is stationarily mounted to the valve housing and a rotating inner wall containing high pressure air which is inserted and relieved from the air inlet plenum during predetermined portions of the overall cycle of the two-cycle engine system.

More in particular, this invention relates to a valve housing for a two-stroke engine where a valve seat is provided with air inlet ports which are skewed with respect to both a vertical direction and a horizontal direction to permit vortexing of air being passed from the air inlet plenum into the combustion chamber.

This invention further pertains to a two-cycle engine which may easily be adapted to a diesel engine application using a glow plug as a substitute for a spark plug. Further, this invention relates to an engine system which through a modular design permits greater electronic manipulation to permit large ranges of parameter changes associated with fuel intake, firing times, valve open/close duration times which allows for varied power and torque combinations, as is necessitated by specific applications.

This invention further relates to a two-cycle engine where the valve large diameter provides an efficient means for expelling exhaust gases from the combustion chamber.

This invention further pertains to a two-cycle engine which provides for a low restriction intake and exhaust commonly referred to as a "free breathing" cycle exchange.

This invention still further pertains to a two-cycle engine which accommodates variable valve timing under computer control without the necessity of complicated mechanical camming mechanisms. Additionally, variable compression is facilitated by the computer control system.

2. Prior Art

Two-cycle internal combustion engines are well-known in the art. In general, such two-stroke engines require two piston strokes or only one revolution for each cycle. However, such prior two-cycle engines generally have a lower piston speed and increased fuel efficiency over four-stroke cycles with less of a variation in the speed and load than that found in four-stroke cycle engines. The best prior art known to Applicant includes U.S. Pat. Nos. 5,857,435; 4,445,467; 5,111,779; 5,190,006; 5,189,996; 5,131,354; 5,163,388; 5,154,141; 5,095,856; 5,331,929; 5,191,858; 5,159,903; 5,133,309; 5,107,801; 4,995,354; 4,995,350; 4,995,347; 5,515,818; and, 5,158,046.

U.S. Pat. No. 5,857,435 patented by the Applicant, is directed to a two-cycle engine which includes some of the features associated with the subject invention concept. However, such does not include the concept of the use of an extended valve stem member which can be actuated and terminated in its displacement by a valve trigger mechanism. In cases where the valve has an extended stem length, the inertia of the valve itself may cause displacement at unwanted times during the cycle. Thus, to increase the overall efficiency of two-cycle engines, the need for a valve trigger mechanism is necessitated. Additionally, the U.S. Pat. No. 5,857,435 reference does not provide for a controlled air insertion mechanism to provide both high pressure air insert and relief of any unwanted high pressure air passing from the combustion chamber through an air inlet plenum.

U.S. Pat. Nos. 5,189,996 and 5,131,354 are directed to two-cycle engine systems which are two-cycle unitary block fuel injected internal combustion engines having electromagnetically operated exhaust valves in the head/input air pump. These systems are complicated in nature and do not provide for any symmetrical contouring, as provided in the subject invention. Neither of these systems provide for modularity of construction or even one-piece construction, nor do they permit cooler valve head temperatures. Such systems result in increased costs of manufacture and operation as well as having a lower engine efficiency.

U.S. Pat. No. 5,111,779 directs itself to an electromagnetic valve actuating system for intake/exhaust valves in an internal combustion engine. Such does not include a valve trigger mechanism which greatly reduces the complexity of the valve operation and ability to operate over wide ranges of environmental conditions.

SUMMARY OF THE INVENTION

This invention is directed to a two-cycle engine which includes a valve housing having a reversibly displaceable valve member. The valve member is displaceable in a substantially vertical direction with the valve member including a valve head and an extended length valve stem. The valve member is displaceable between an open position and a closed position. A cylinder housing is included which is vertically aligned and secured to the valve housing and is mounted below the valve housing. The cylinder housing has an upper section and a lower section forming a combustion chamber containing a reversibly displaceable piston member. The cylinder housing upper section has at least two air intake ports and a fuel injection port, as well as a mechanism for igniting a fuel and air mixture which may be a spark plug or glow plug. The cylinder housing lower section includes an exhaust port for egress of exhaust gases. A crank housing is coupled to the cylinder housing lower section which contains a crank member coupled to the piston member. An air intake plenum is located in a lower section of the valve housing and surrounds the valve stem. The air intake plenum is in fluid communication with the air intake port for insertion of high pressure air into the combustion chamber. A valve control mechanism initiates displacement of the valve member when the valve member is in a substantially open position and initiates displacement of the valve member after the valve member is in the closed position.

An object of the subject invention is to provide a lightweight engine which is compact in size and is adaptable for insert into a smaller volume vehicle.

Another object of this invention is to provide a two-cycle engine which includes a design which is simple in fabrication and generally symmetrical in construction having a resulting low cost of manufacture.

A still further object of this invention is to provide a two-cycle engine which may be formed in generally one-piece construction for modular construction and which may be easily assembled, repaired, and replaced with interchanging components between differing engine systems.

Another object of the invention is to provide a low-weight two-cycle engine which is compact in size and may be located between the axles of the front and/or rear wheels of a vehicle whereby the engine may be mounted by itself or in combination with other engines to one or more axles of the vehicle. In this manner, a plurality of two-cycle engine systems of the subject design may be used in one vehicle to drive front/rear axles.

It is a further object of this invention to provide a two-cycle engine which maximizes the friction efficiency and lowers the friction loading characteristics normally found to inhibit the performance of internal combustion engines.

It is still a further object of this invention to provide a two-cycle engine which includes a mechanism for triggering a valve displacement and for aiding in initiating such displacement based upon a solenoid actuation system.

A still further object of this invention is to provide a two-cycle engine which is generally symmetrical in construction and permits vortex displacement for intake gases to aid in the intake/exhaust portions of the cycle.

A further object of this invention is to provide a two-cycle engine which is easily adaptable to prior art four-cycle crank assemblies while having a minimal transmission change with respect to four-cycle crank assemblies.

A further object of this invention is to provide a two-cycle engine where high pressure air may be inserted from a high pressure chamber to the combustion chamber of the two-cycle engine in a vortexing manner to create added turbulence in the combustion chamber to thoroughly discharge spent gases and further thoroughly mix the fuel/air mixture prior to ignition.

DESCRIPTION OF THE PREFERRED EMBODIMENTS

Figure 1:
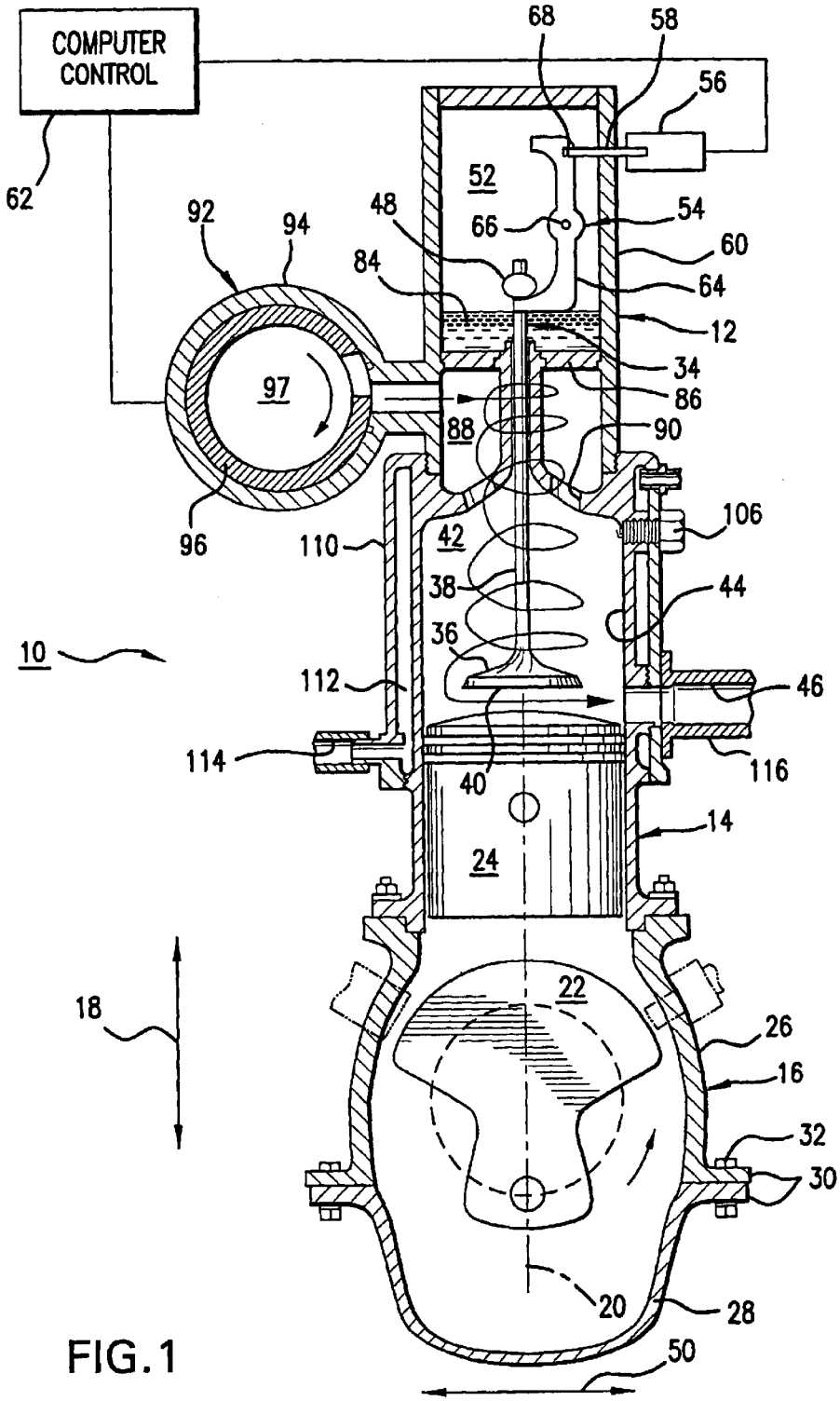
FIG. 1 is a cross-sectional elevational view partially cut-away of the two-cycle engine of this invention concept showing a valve member in an open position.

Referring now to FIGS. 1–6, there is shown two-stroke cycle internal combustion engine 10 which includes vertically aligned valve housing 12, cylinder housing 14, and crank housing 16. As is seen, valve housing 12, cylinder housing 14, and crank housing 16 are generally aligned each to the other in vertical direction 18 and is formed substantially symmetrical about vertical axis line 20.

In fact, cylinder housing 14 and crank housing 16 may be formed in one-piece formation or otherwise bolted or fixedly coupled in some like manner each to the other. By providing the particular symmetrical concept of construction, construction costs are minimized, overall design is simplified, and there is formed an economically acceptable modularly constructed two-cycle engine 10 which may be easily replaced with interchanging parts providing a generally low cost engine system which is easily repairable through the interchanging of the parts.

Two-stroke engine 10 may be formed of cylinder housing 14 which may be either molded or machined in one-piece formation to correspondingly fit or otherwise be coupled to crank housing 16 and valve housing 12 in a construction mode to provide modularity between the cooperating elements.

Figure 2:
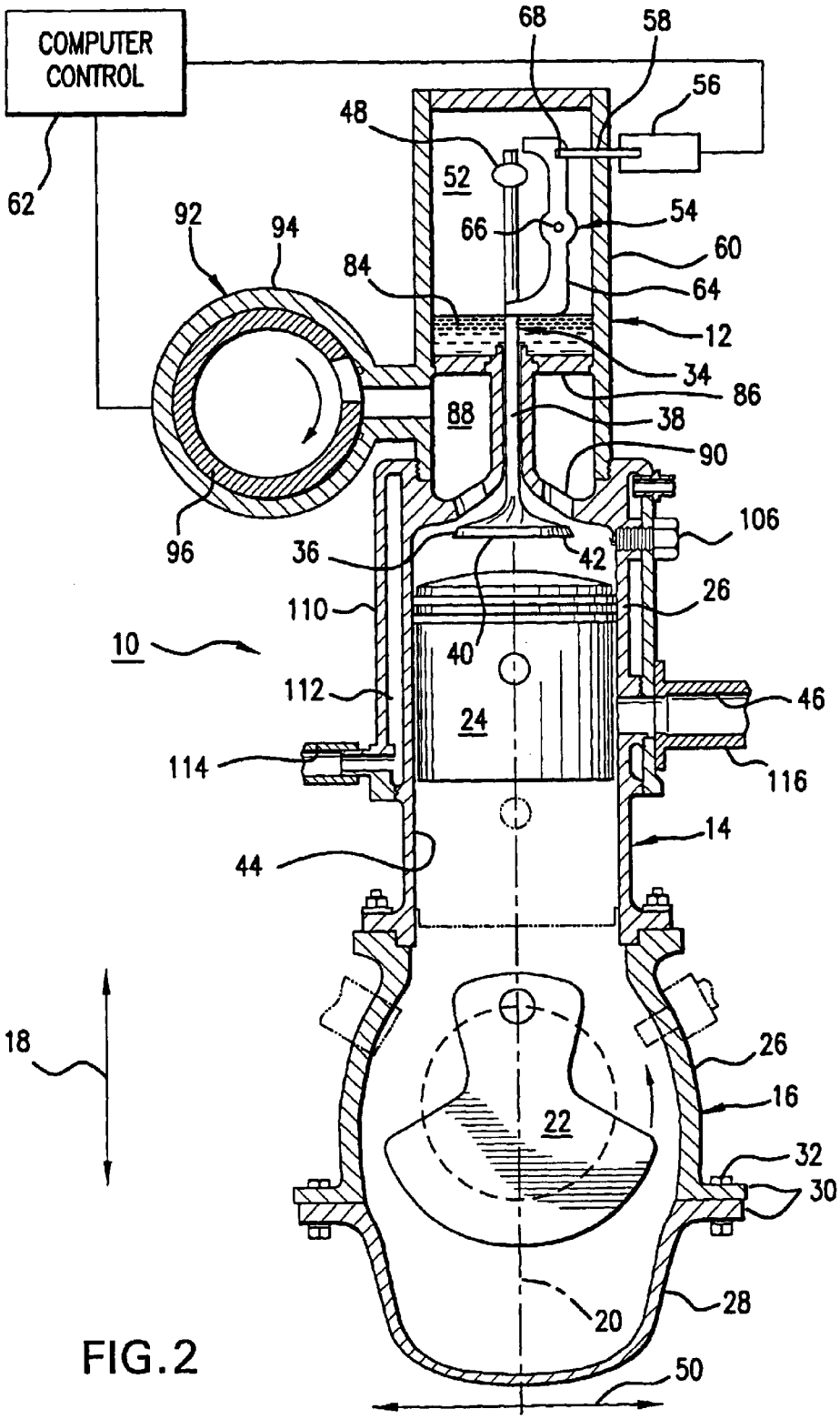
FIG. 2 is a cross-sectional view partially in cut-away of the two-cycle engine of this invention concept showing the valve member in a partially closed condition.

Crank housing 16 includes a standard crank 22 contained therein which is coupled to piston 24 in the normal manner of operation of an internal combustion system well-known in the art. Crank housing 16 is formed of crank housing upper section 26 and crank housing lower section 28 as is shown in FIGS. 1 and 2. Crank housing lower section 28 basically forms an oil pan, as is known in the prior art. Crank housing upper section 26 and crank housing lower section 28 may be bolted or otherwise joined each to the other at crank housing flange 30 through crank housing bolt members 32. In this manner, a one-piece crank housing 16 is formed to enclose crank 22 and form the standard oil pan section of two-stroke cycle internal combustion engine 10. Crank housing 16 may be formed of a steel composition, or some like metal composition not important to the invention concept as herein described, with the exception that crank housing 16 be formed of a composition which is structurally capable of accepting the force loads provided thereto and maintains structural integrity in view of the temperatures imparted thereon.

As seen in FIGS. 1 and 2, valve housing 12 includes therein reversibly displaceable valve member 34 which is vertically displaceable in vertical direction 18. Valve member 34 includes valve head 36 and extended length valve stem 38. Valve member 34 may be formed of a metal composition, preferably steel or like composition to accept the thermal loads imparted thereon. As seen, valve stem 38 is of extended length and extends internal valve housing 12 and cylinder housing 14. Valve stem 38 and valve head 36 may be formed in one-piece formation and includes valve head 36 having an arcuate inner surface 38 for reversible displacement within combustion chamber 42.

It is of importance that valve stem 38 is of a length such that at the end of the exhaust portion of the engine cycle that the valve head 36 is adjacent the exhaust port 46, as is shown in FIG. 1.

Actuation of valve member 34 is mainly accomplished in a manner which does not necessitate the need of a spring member although a spring may be added to provide a biasing force. Generally, displacement of valve member 34 is accomplished by expansion of gases driving the valve member upward and by gravity assist when the valve member 34 is displaced in a downward direction.

Valve head 36 includes a head diameter which is substantially greater than standard valves found in prior art internal combustion engines and includes a diameter of valve head 36 being approximately equal to one-half the internal diameter of bore 44 of cylinder housing 14. In this manner, valve member 34 may aid in passage of gases through exhaust port 46 during predetermined portions of the cycle of the two-stroke cycle internal combustion engine 10. Further, the enlarged diameter of valve head 36 provides for an upper surface where high pressure air being inserted aids in the downward displacement in vertical direction 18 of valve member 34.

Figure 6:
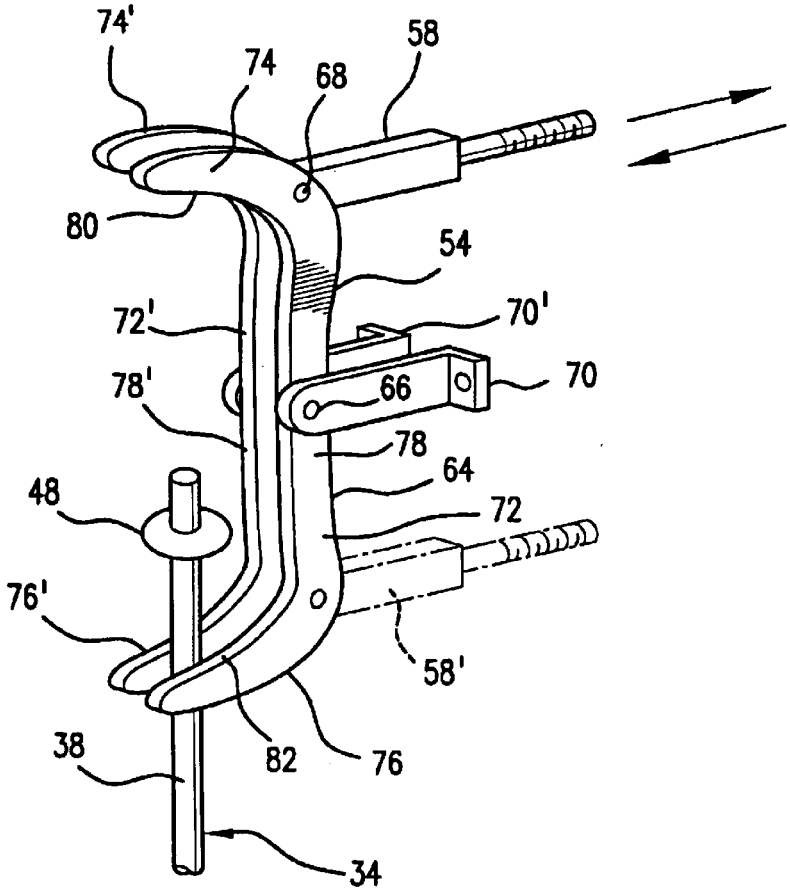
FIG. 6 is a perspective view of the valve trigger mechanism taken partially in cutaway; and, FIG. 7 is a cross-sectional view, partially cut-away showing the arcuate surface contour of the valve member.
Figure 7:
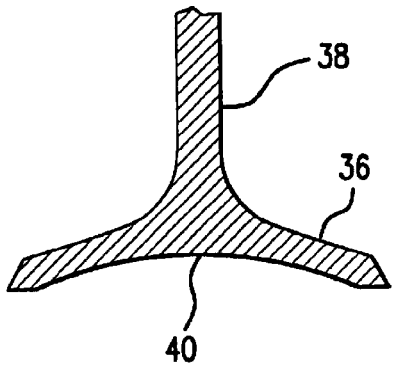

At an upper end of valve stem 38, there is formed stop member or lug member 48 which extends from valve stem 38 in transverse direction 50, as is shown in FIG. 6. Stop or lug member 48 is maintained within valve housing chamber 52 of valve housing 12 throughout the cycling process of two-stroke cycle internal combustion engine 10. Thus, as is seen in FIGS. 1 and 2, extended length valve stem 38 passes in a reversible vertical direction 18 within valve housing chamber 52 to permit opening and closing of valve member 34, as will be described in following paragraphs.

Within valve housing chamber 52, there is provided valve control mechanism 54 for terminating displacement of valve member 34 when valve member 34 is moved to a substantially open position (at a lower displacement point) and then to initiate displacement of valve member 34 when the valve 34 begins an upward displacement as seen in FIG. 1. Additionally valve control mechanism 54 provides for aiding in the initiating of the displacement of valve member 34 when valve member 34 is in a substantially closed position (at a higher displacement point). Valve control mechanism 54 includes at least one solenoid 56 which is operable in a well-known manner to drive solenoid rod member 58 in a reversible transverse direction 50. Solenoids 56 of this type are commercially available and are well-known in the prior art. Solenoid actuating rod 58 is driven in reversible transverse direction 50 at predetermined points in the two-stroke cycle of internal combustion engine 10 in a well-known manner. Solenoid 56 is driven by computer control system 62 which is known in the prior art and does not form part of the subject invention concept.

Solenoid actuating rod 58 passes through valve housing wall 60 in a manner which substantially contiguous to an opening formed in wall 60 but allows reversible transverse direction 50 displacement.

Solenoid actuating rod 58 is pivotally coupled to valve trigger mechanism 64 which is positionally located internal valve housing 12 and particularly internal to valve housing chamber 52 for interception and/or blocking of the vertical displacement of valve member 34 when valve member 34 is in a substantially open and closed position. Valve trigger mechanism 64 is pivotally coupled to valve housing wall 60 and then further coupled at an upper end thereof to solenoid actuating rod 58, as is seen. As seen in FIGS. 1, 2, and 6, upper end of valve trigger mechanism 64 is pivotally coupled to solenoid rod 58 at pivot point 68.

Pivoting of trigger mechanism 64 with respect to valve housing wall 60 is provided by trigger valve brackets 70 which may be mounted to wall 60 through bolts or some like mechanism and are pivotally connected to trigger mechanism 64 at pivot point 66. Thus, as solenoid rod 58 is driven in reversible transverse direction 50, valve trigger mechanism 64 is rotationally driven about trigger pivot point 66.

Valve trigger mechanism 64 includes at least one trigger member 72 which is generally C-shaped in contour having trigger member upper arm 74 and trigger lower arm 76 which are joined each to the other in one-piece formation by trigger base member 78. Trigger base member 78 is pivotally coupled to valve housing wall 60 at pivot 66, as is shown in FIGS. 1 and 2.

Trigger member upper arm 74 includes inclined or arcuately directed upper surface 80 and trigger member lower arm 76 includes arcuate or inclined lower surface 82 for interface with stop or lug member 48, as will be described in following paragraphs.

Inclination of trigger member upper arm inclined surface 80 and trigger member lower arm inclined surface 82 are of importance to allow gradual initiating of the displacement of valve member 34 when upper and lower arm members 74 and 76 intercept the path of valve lug or stop member 48. Additionally lower arm member 76 provides a stop for displacement of valve member 34 as it reaches its fully opened position. The main function of upper arm member 74 and its respective inclined surface 80 is to aid in the initiating of the downward displacement of valve member 34 when it begins its displacement from a closed position to an open position.

In a preferred embodiment, valve trigger mechanism 64 may be formed by two trigger members 72 and 72' which are spaced apart each from the other in a fixed manner by the insertion of solenoid rod member 58 therebetween. A spacer may be used within trigger brackets 70 and 70' to maintain a displacement between trigger brackets 70 and 70'. The spacing between trigger brackets 70 and 70' must have a spacing distance greater than the diameter of valve stem member 38, but less than the diameter of lug or stop member 48 to provide a blocking member during the vertical displacement of valve member 34. The combination of the trigger members 72 and 72' provides a guide for valve member 34 and valve stem 38 during the reversible vertical displacement thereof. Where a pair of trigger members 72 and 72' are provided, trigger member 72 includes respective trigger member lower arm 76' and trigger member upper arm 74', as was previously described for trigger member 72. Trigger member 72' is substantially identical to trigger member 72 and includes base member 78'.

It is to be understood that an optional solenoid member 56' may be coupled to trigger member lower arm 76 to aid in the displacement of trigger member 72 and 72' in transverse direction 50.

In this manner, as seen in FIG. 1, when valve member 34 has opened and has moved to substantially the bottom center position of the cycle of internal combustion engine 10, that lower arm inclined surface 82 is moved or displaced beneath stop member 48 to provide a termination of the downward displacement of valve member 34. Additionally, when the cycle has reached the top center position, trigger arm upper inclined surface 80 is displaced to initiate pushing against the stop member 48 and gradially initiate vertical downward displacement. During the valve closing portion of the cycle of internal combustion engine 10, solenoid 56 actuates solenoid rod 58 which is displaced in a direction to allow gradual initiation of the upward displacement of stop member 48 and the resultant displacement of stem 48 in an upward direction. In this manner, a gradual vertical displacement of valve member 34 is accomplished to aid in the upward force generation.

Valve housing chamber 52 may have contained therein oil composition 84 to permit an aid in the lubrication of stem 38 through its reversible vertical displacement during cycling of internal combustion engine 10. Oil composition 84 may be a standard oil composition well-known in the art. Valve housing 12 includes lower wall 86 fixedly attached to valve housing wall 60 in either one-piece formation or otherwise coupled to provide a fluid-tight seal for oil composition 84 in order that oil composition 84 be contained fully within valve housing chamber 52.

Figure 4:
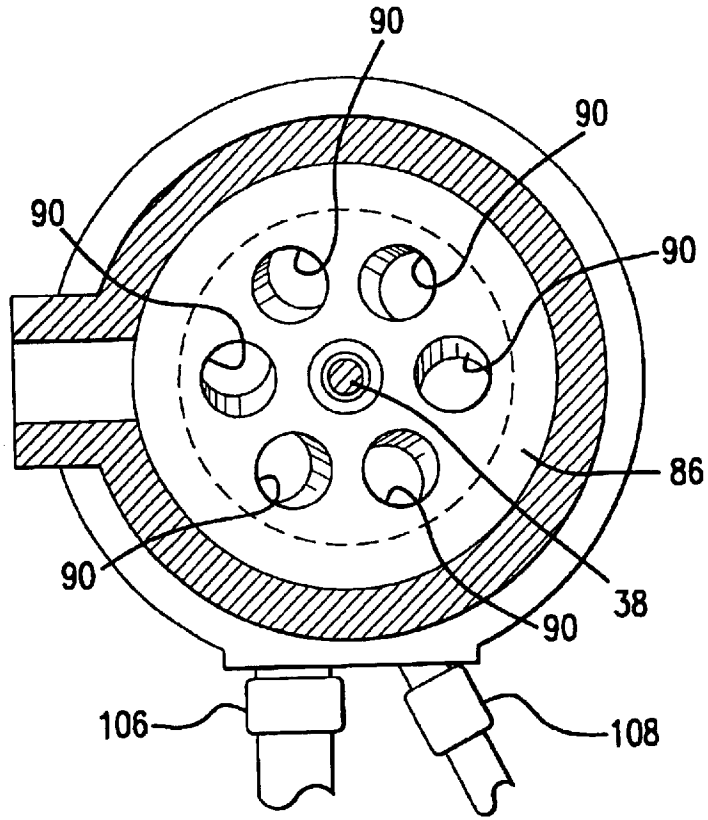
FIG. 4 is a cross-sectional view of the lower portion of the valve housing showing skewed air inlet ports for insertion of air into the combustion chamber of the engine system.

Air intake plenum 88 is located within valve housing 12 in a lower section thereof and surrounds valve stem 38, as is shown in FIGS. 1 and 2. Air intake plenum 88 is in fluid communication with combustion chamber 42 through inlet ports 90. Air inlet ports 90, as is seen in FIG. 4 are inclined with respect to the vertical direction 18 and transverse direction 50 in order to provide a skewed insert of air into combustion chamber 42. In this manner, air inlet plenum 88 provides high pressure air being vortexed into combustion chamber 42 to create turbulence and mixing of the fuel/air mixture and thereby aid in the combustion process. Vortexing of the air entering combustion chamber 42 will aid in the exhaust phase of the spent gases since such provides the turbulence vortex which increases the efficiency in removal of the spent gases while simultaneously mixing the substantially high pressure pure air mixture within combustion chamber 42. It is further seen that the vortexing of the air provides an advantage to the overall combustion process which is derived from the substantially constant temperature being provided throughout combustion chamber 42 where thermal degradation stresses are reduced over that previously seen in prior art internal combustion engines and particularly in two-cycle internal combustion engines.

Referring now to FIGS. 3A–3D, two cycle engine 10 further includes control air insertion mechanism 92 which is coupled to valve housing wall 60 at a lower section thereof through bolting or some other technique to provide a substantially hermetic seal. Controlled air insertion mechanism 92 is coupled to wall 60 of valve housing 12 and is in fluid communication with air intake plenum 88 for ultimately charging combustion chamber 42 with high pressure air.

Controlled air insertion mechanism 92 as seen in FIGS. 3A–3D includes stationary outer wall 94 and a rotating inner wall 96 which provides for a high pressure rotary plenum configuration. Pressure is maintained within open inner wall chamber 98 through actuation of computer control system 62 which controls a source of high pressure air from a fan, blower, air charger, or some like system which is not part of the invention as herein described. Stationary outer wall or stationary conduit 94 includes an arcuately directed stationary conduit plenum 98 formed through stationary wall 94 for fluid communication with air intake plenum 88. Rotatably displaceable conduit or rotatable inner wall 96 is concentrically located within stationary conduit 94 and is rotatable with respect thereto. Rotatably displaceable conduit 96 includes rotatable displaceable conduit opening 100 for alignment with stationary conduit plenum opening 98 during rotational displacement of rotatably displaceable conduit 96 at predetermined portions of the cycle of internal combustion engine 10.

Figure 3A:
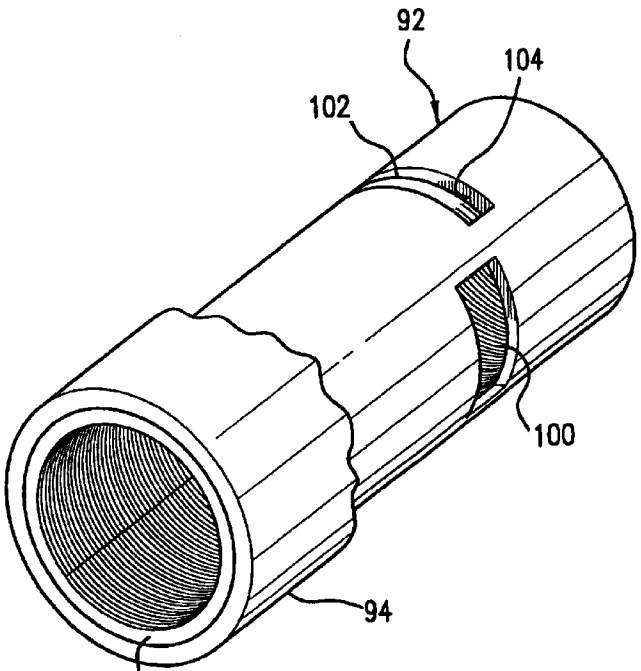
FIG. 3A is a perspective view of the controlled air insertion mechanism showing a cutaway stationary wall and the rotating inner wall.
Figure 3B:
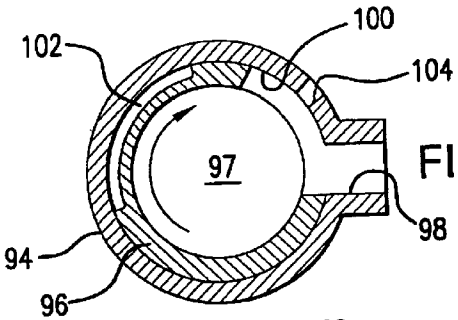
FIG. 3B is a cross-sectional elevational view of the controlled air insertion mechanism during the intake mode of the engine cycle.
Figure 3C:
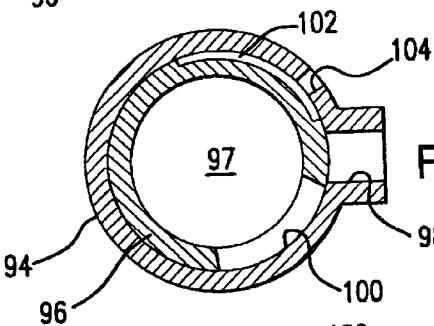
FIG. 3C is a cross-sectional elevational view of the controlled air insertion mechanism at the time of intake being completed in the engine cycle.

In this manner, when rotatable displaceable conduit opening 100 is aligned with outer wall plenum opening 98, high pressure air charges air plenum 88 for insertion thereby of combustion chamber 42. As is seen in FIG. 3B, during the intake mode, rotatable displaceable conduit opening 100 is in alignment with plenum opening 98 to provide a fluid communication path between the high pressure chamber 97 formed within rotating inner wall 96 and plenum 88. As seen in FIG. 3C when intake has been completed, rotating inner wall 96 has moved into a blocking path to terminate flow of air from chamber 97 to plenum 88.

Figure 3D:
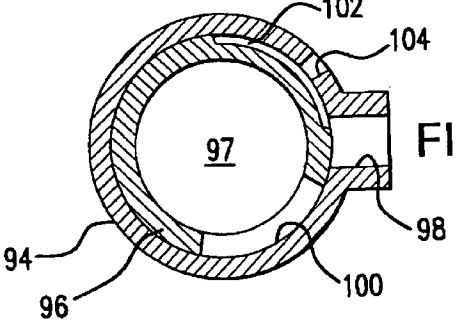
FIG. 3D is a cross-sectional view of the controlled air insertion mechanism at the time of intake port pressure relief.

Inner rotating conduit wall 96 further includes pressure relief formed in an outer surface of inner wall 96 to provide pressure relief from air plenum 88 in the manner shown in FIG. 3D where there is communication between air plenum 88 to recess 102 and then through relief opening 104 formed through an outer wall of stationary conduit wall member 94. In this manner, extraneous gases which may be under pressure may be forced back into air plenum 88 and then released through the fluid communication of air plenum 88 and recess 102 and finally through relief opening 104.

Recess 102 formed through an outer wall 94 when in alignment with the stationary pressure relief opening 102 relieves any excess pressures resulting in combustion chamber 42.

Spark plug 106 generally extends through a wall of cylinder housing 14 at an upper section thereof. Spark plug 106 is generally aligned in a horizontal plane with fuel injection mechanism 108 which is common in the art. Fuel injector 108 and spark plug 106 are more clearly shown in FIG. 4. Where both spark plug 106 and fuel injector mechanism 108 extends internal combustion chamber 42 below skewed air inlet port 90. In order to reduce high temperature considerations within internal combustion engine 10, there may be provided cooling jacket 110 having a cooling jacket 112 for insert thereto of cooling fluid through cooling jacket conduit 114. Formed through a wall of cylinder housing 14 is exhaust port 116 for removal of spent gases being combusted within combustion chamber 42.

Figure 5:
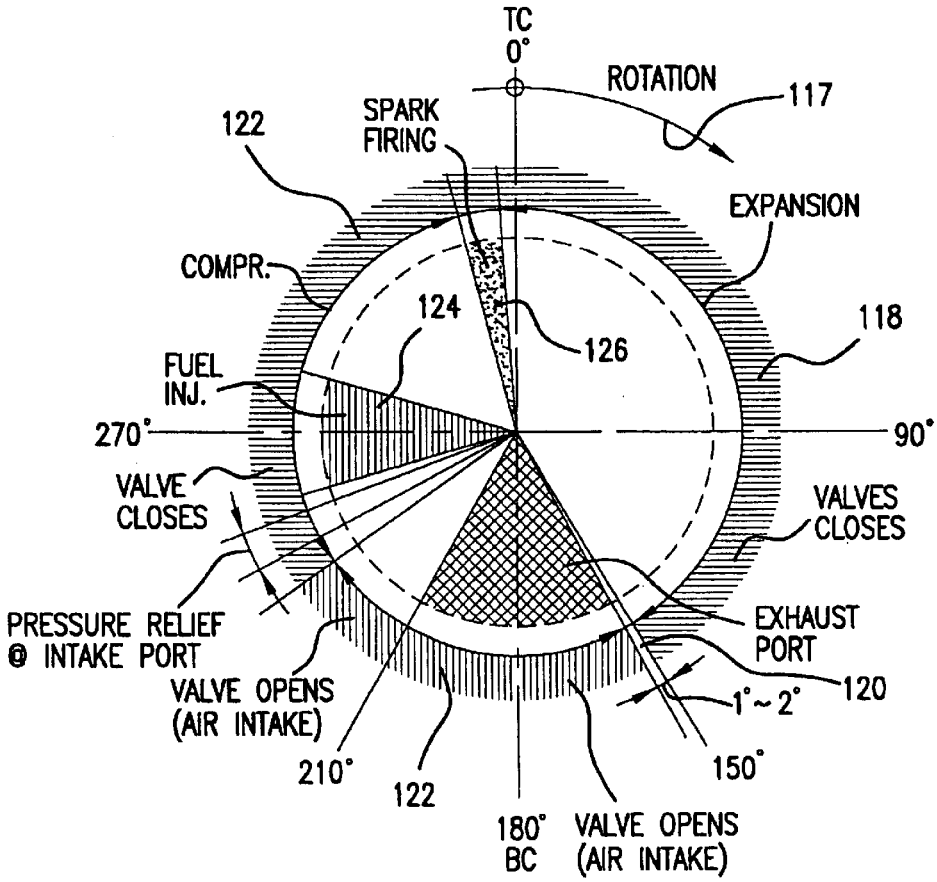
FIG. 5 is a timing diagram used for the subject invention system.

A typical timing diagram is shown in FIG. 5 where one revolution of 360° corresponds to a motion of piston member 24 from a top dead center (TC) to a bottom dead center (BC) and then a return to top dead center (TC). The timing of valve control member 34 from open to closed and closed to open positions is maintained under the control of computer control 62 which may be changed or adjusted for maximization of efficiency of two-stroke cycle internal combustion engine 10. Beginning at top dead center and taking the rotation in the direction of rotational arrow 117, valve member 34 is maintained in a closed manner within valve closure region 118 for approximately 150° of the cycle. Transition of the opening of valve member 34 begins within 1°–2° of the overall cycle in transition zone 120 and is then opened in valve open zone 122 wherein valve member 34 remains open until approximately 240° into the cycle.

At this point, valve member 34 begins closure and pressure relief recess 102 comes into alignment with relief opening 104 of controlled air insert mechanism 92. Valve member 34 remains closed until top dead center is reached. Fuel injection is initiated during valve closure in fuel injection region 124 and is initiated approximately at 255° into the cycle and fuel injection terminates approximately at 280° into the cycle. Spark plug 106 fires shortly before top dead center in spark plug firing region 126 approximately 10–20° before top dead center is reached. Exhaust port 116 is opened approximately at the 150° range from top dead center and remains open until 210°.

Although this invention has been described in connection with specific forms and embodiments thereof, it will be appreciated that various modifications other than those discussed above may be resorted to without departing from the spirit or scope of the invention, for example, functionally equivalent elements may be substituted for those specifically shown and described, proportional quantities of the elements shown and described may be varied, and in the formation of the particular steps described, particular steps may be reversed or interposed, all without departing from the spirit or scope of the invention as defined in the appended claims.

What is claimed is:

1. A two cycle engine comprising:

(a) a valve housing having a reversibly displaceable valve member displaceable in a substantially vertical direction, said valve member having a valve head and a valve stem, said valve member being displaceable between an open position and a closed position;

(b) a cylinder housing being substantially vertically aligned and secured to said valve housing, said cylinder housing having an upper section and a lower section forming a combustion chamber containing a reversibly displaceable piston member, said cylinder housing upper section having (1) at least two air intake ports, (2) a fuel injection port, and (3) means for igniting a fuel and air mixture, said cylinder housing lower section having an exhaust port for egress of exhaust gases;

(c) a crank housing coupled to said cylinder housing lower section for containing a crank member coupled to said piston member;

(d) an air intake plenum located within said valve housing and surrounding said valve stem, said air intake plenum in fluid communication with said intake ports; and, (e) valve control means for initiating displacement of said valve member when said valve member is in a substantially open position and terminating displacement of said valve member when said valve member is in a substantially closed position, said valve control means including:

(i) a solenoid having a solenoid actuating rod extending through a wall of said valve housing; and (ii) valve trigger means located internal said valve housing, for intercepting said valve member when said valve member is in said substantially open and closed positions, said valve trigger means being pivotally coupled to said valve housing wall and coupled to said solenoid actuating rod.

2. The two cycle engine as recited in claim 1 where said valve stem includes a stem lug member extending in a transverse direction for being contacted by said valve trigger means is pivotally rotated by said solenoid actuating rod.

3. The two cycle engine as recited in claim 2 where said valve trigger means includes at least one C-shaped trigger member having opposing upper and lower arm members and a substantially vertically directed base element pivotally coupled to said valve housing wall.

4. The two cycle engine as recited in claim 3 where said solenoid actuating rod is coupled to either said upper or lower arm members of said C-shaped trigger member.

5. The two cycle engine as recited in claim 3 where said opposing upper and lower arm members extend in an inclined direction with respect to said vertical direction for gradually initiating and terminating displacement of said valve member when said upper and lower arm members intercept said valve lug member.

6. The two cycle engine as recited in claim 2 where said valve trigger means includes a pair of C-shaped trigger members each having opposing upper and lower arm members, said C-shaped trigger members being displaced from each other in said transverse direction by a distance greater than an outer diameter of said valve stem for capturing said valve stem therebetween and less than a transverse dimension of said stem lug member.

7. The two cycle engine as recited in claim 1 where said air intake ports are angularly formed through an upper section wall of said cylinder housing for providing fluid communication from said air intake plenum to said combustion chamber.

8. The two cycle engine as recited in claim 7 where air intake ports are skewed with respect to a vertical axis of said vertically directed valve member for providing a vortexing of air being inserted to said combustion chamber from said air intake plenum.

9. A two cycle engine comprising:

(a) a valve housing having a reversibly displaceable valve member displaceable in a substantially vertical direction, said valve member having a valve head and a valve stem, said valve member being displaceable between an open position and a closed position, said valve housing including an oil composition disposed therein for maintaining lubrication of said valve during displacement;

(b) a cylinder housing being substantially vertically aligned and secured to said valve housing, said cylinder housing having an upper section and a lower section forming a combustion chamber containing a reversibly displaceable piston member, said cylinder housing upper section having (1) at least two air intake ports, (2) a fuel injection port, and (3) means for igniting a fuel and air mixture, said cylinder housing lower section having an exhaust port for egress of exhaust gases;

(c) a crank housing coupled to said cylinder housing lower section for containing a crank member coupled to said piston member;

(d) an air intake plenum located within said valve housing and surrounding said valve stem, said air intake plenum in fluid communication with said intake ports; and, (e) valve control means for initiating displacement of said valve member when said valve member is in a substantially open position and terminating displacement of said valve member when said valve member is in a substantially closed position.

10. A two cycle engine comprising:

a valve housing having a reversibly displaceable valve member displaceable in a substantially vertical direction, said valve member having a valve head and a valve stem, said valve member being displaceable between an open position and a closed position;

a cylinder housing being substantially vertically aligned and secured to said valve housing, said cylinder housing having an upper section and a lower section forming a combustion chamber containing a reversibly displaceable piston member, said cylinder housing upper section having (1) at least two air intake ports, (2) a fuel injection port, and (3) means for igniting a fuel and air mixture, said cylinder housing lower section having an exhaust port for egress of exhaust gases;

a crank housing coupled to said cylinder housing lower section for containing a crank member coupled to said piston member;

an air intake plenum located within said valve housing and surrounding said valve stem, said air intake plenum in fluid communication with said intake ports;

valve control means for initiating displacement of said valve member when said valve member is in a substantially open position and terminating displacement of said valve member when said valve member is in a substantially closed position; and, controlled air insertion means coupled to a wall of said valve housing in fluid communication with said air intake plenum for charging said combustion chamber with high pressure air, said controlled air insertion means including:

(a) a stationary conduit having an arcuately directed stationary conduit planar opening formed through a wall thereof for fluid communication with said air intake plenum; and, (b) a rotatably displaceable conduit concentrically located within said stationary conduit and rotatable with respect thereto, said rotatably displaceable conduit having a rotatably displaceable conduit opening for alignment with said stationary conduit plenum opening during rotational displacement of said rotatably displaceable conduit.

11. The two cycle engine as recited in claim 10 where said rotatably displaceable conduit includes a recess formed within an outer wall thereof for alignment with a stationary conduit pressure relief opening formed through said wall of said stationary conduit for relief of excessive pressures in said combustion chamber.

12. The two cycle engine as recited in claim 11 where said rotatably displaceable conduit recess is aligned with said stationary conduit pressure relief opening and is in fluid communication with said air intake plenum during a predetermined portion of a cycle of said two cycle engine.

13. The two cycle engine as recited in claim 10 where said air intake ports are angularly through an upper section wall of said cylinder housing for vortexing high pressure air into said combustion chamber when said stationary conduit plenum opening and said rotatably displaceable conduit opening are in fluid communication with said air intake plenum.

14. The two cycle engine as recited in claim 13 where said air intake ports extend in a skewed line with respect to a vertical axis of said cylinder housing.

15. The two cycle engine as recited in claim 14 where said air intake ports are positioned symmetrically about said vertical axis of said cylinder housing.

16. The two cycle engine as recited in claim 10 where said valve head is substantially circular in cross-section and includes a diameter substantially one-half the diameter of a base of said cylinder housing for efficiently expelling exhaust gases.

17. The two cycle engine as recited in claim 16 where said value head includes a lower surface which is arcuately formed.

18. The two cycle engine as recited in claim 10 where said value housing includes an oil composition for lubricating said valve stem.

* * * * *